US006202989B1

(12) United States Patent
Pattullo

(10) Patent No.: US 6,202,989 B1
(45) Date of Patent: Mar. 20, 2001

(54) CARBURETOR THROTTLE AND CHOKE CONTROL MECHANISM

(75) Inventor: George M. Pattullo, Caro, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/252,257

(22) Filed: Feb. 18, 1999

(51) Int. Cl.[7] ..... F02M 1/02
(52) U.S. Cl. ..... 261/52; 123/179.18; 261/64.6
(58) Field of Search ..... 261/52, 64.6; 123/179.18, 123/339.25, 185.14, 185.1

(56) References Cited

U.S. PATENT DOCUMENTS

| | | | | |
|---|---|---|---|---|
| 2,160,411 | * | 5/1939 | Blattner et al. | 261/52 |
| 4,123,480 | * | 10/1978 | Johansson | 261/52 |
| 4,167,929 | * | 9/1979 | DuBois | 123/185.1 |
| 4,176,648 | * | 12/1979 | Gotoh et al. | 123/185.14 |
| 4,230,084 | * | 10/1980 | Gotoh et al. | 123/185.14 |
| 4,368,704 | * | 1/1983 | Masaki | 123/339.25 X |
| 5,069,180 | * | 12/1991 | Schmidt et al. | 123/179.18 X |
| 5,200,118 | * | 4/1993 | Hermle | 261/64.6 |
| 5,500,159 | * | 3/1996 | Martinsson | 261/52 |
| 5,611,312 | * | 3/1997 | Swanson et al. | 123/436 |
| 5,891,369 | * | 4/1999 | Tuggle et al. | 261/52 X |
| 6,000,683 | * | 12/1999 | Van Allen | 123/179.18 X |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A control mechanism for a carburetor having a throttle valve and a choke valve each having at least a cold-starting position and a full-speed position. The throttle valve is spring biased toward its third, low idle position, and the choke valve is mounted on a choke shaft and is spring biased toward its full-speed open position. When the choke valve is moved by a choke shaft lever from its open position toward its cold start closed position a fast idle lever associated with the choke valve shaft engages, via releasable latch parts, a throttle lever associated with the throttle valve. The interengaging latch parts of these fast idle and throttle levers hold both valves in their respective cold-starting positions in opposition to their respective biasing springs. These latch levers can be released by operator actuation of the throttle valve control, thereby causing the choke valve to be automatically returned to its open position by its biasing spring, or, alternatively, the choke valve can be moved independently to its full-speed position. One of these fast idle and throttle latch levers has a notch, and the other has a pawl selectively engaging the notch when it becomes aligned therewith when the latch levers are operator-actuated to their respective cold start positions. The choke shaft is torsionally resilient so that when the choke shaft lever is forced to override initial-choke-closed position, it thereby twists the choke shaft after the choke valve has been bore-stopped at closed position. Upon release of operator actuating force, this feature prevents most, if not all of the previous retrograde movement of the choke and throttle valves out of their design cold start positions, despite operating slack in the latch system due to manufacturing tolerance stack-up in the various parts of the latch system parts and/or control mechanism in their assembly and operation.

15 Claims, 7 Drawing Sheets

JOHANSSON 4,123,480:

HERMLE 5,200,118:

JOHANSSON 4,123,480
AT NOMINAL

JOHANSSON 4,123,480
AT ONE TOLERANCE LIMIT

CHOKE NOMINAL THROTTLE

CARBURETOR THROTTLE AND CHOKE CONTROL MECHANISM

FIELD OF INVENTION

The present invention relates to throttle and choke control mechanisms of carburetors for internal combustion engines, and more particularly to such a mechanism incorporating a choke-throttle cold-start-setting latch mechanism that automatically positions the throttle valve slightly open when the choke valve is fully closed.

BACKGROUND OF THE INVENTION

In small carburetors designed for use with low displacement gasoline fueled engines, such as used on chain saws, weed whips, lawn mowers, garden tractors and other small lawn, garden, and forestry portable appliances, manually operated choke and throttle controls are typical provided and often hand cranking is employed for starting the engine. Prior to the late 1970's, chain saws equipped with such choke and throttle controls often involved a basic starting sequence which left much to be desired. First the choke valve was fully closed to its start position, and then the starter rope was pulled until the engine fired. The closed choke valve usually caused the engine to immediately die at this first firing due to over-enrichment of the air/fuel (A/F) mixture. This is commonly referred to as a false start. At this point the choke valve had to be opened. Then the starter rope was pulled again until the engine finally began running.

This starting sequence was subsequently improved by adding another start-up control to the chain saw whereby the throttle valve could be held at a partly opened position, known as fast idle position. This generally avoided false starts due to the increased air flow permitted past the throttle valve.

In order to avoid the need for three separate manually operated controls, namely, a throttle control, a choke control and fast idle start control, Johansson U.S. Pat. No. 4,123,480, issued Oct. 31, 1978 (which is incorporated herein by reference), disclosed an improved chain saw engine control mechanism. The automatic fast idle setting mechanism of the Johansson patent U.S. Pat. No. 4,123,480 is shown herein in FIGS. 1, 2 and 3 which correspond respectively to FIGS. 1, 3 and 4 of the '480 patent. The direction of air-flow through the carburetor throat is indicated by the arrow labeled "A" in these views, as well as in all other views in the drawings herein. For convenience, the reference numerals employed in FIGS. 1, 2 and 3 are those employed in '480 patent, to which further reference may be made for the details of the construction and operation of the same.

In the '480 patent a fast idle secondary lever 9 is pivoted on the choke valve shaft 11 and is operable to engage tang 7 of a latch arm of a throttle lever 4 fixed on the throttle valve shaft 2 to cause the throttle valve 1 to open to a predetermined angle corresponding to the fast idle position (FIG. 2). With this arrangement, the operator need only operate a single start-up control, namely the choke valve control (not shown) coupled to the choke shaft control lever 12 in order to set the throttle 1 in fast idle condition. Thus, when the operator moves the choke control to swing the choke valve 10, via lever 12, from fully open position (FIG. 1) to its fully closed start position (FIG. 2), the pivotal motion of choke shaft control lever 12, via a coupling tang 14 on the adjacent fast idle lever 9, pivots fast idle lever 9 and causes its notch 8 to latch engage and hold the throttle lever latch arm tang 7, thereby automatically setting the fast idle latch mechanism. The bias of the respective choke and throttle shaft return springs 15 and 3 also provide the yieldable latch closing forces.

Then, if the chain saw engine experiences a false start, the choke lever 12 may be moved to the open position (FIG. 3) without thereby moving the fast idle lever 9 so that it remains engaged with the throttle lever 4 to retain the throttle valve 1 in the fast idle position. Once the chain saw engine starts, the operator simply depresses the throttle control trigger 6 to open the throttle valve 1. This pivots the throttle shaft lever 4, thereby causing it to disengage the fast idle lever 9 and thus cause release of the latch. If the choke valve 10 was still in the closed position at this point, the choke biasing spring 15, acting through the fast idle lever 9 and tang 14 coupling it to the choke lever, would automatically cause the choke valve 10 to be returned to full open position upon such unlatching of the fast idle lever 9 from the throttle lever 4 (FIG. 1).

One of the disadvantages of this '480 patent design is its failure in practice when mass produced to insure complete and/or consistent closure of the choke valve 10 when setting the fast idle latch starting system. The specific problem has been found to be due to the choke valve sometimes not completely closing even though the operator has fully engaged the choke control to indicated start position. Further, it has been found that this problem is due to a stack up of normal manufacturing tolerances in the parts as manufactured for assembly into the fast idle latch mechanism.

Such manufacturing tolerances are, of course, necessary to set up minimum dimensional range limits or allowances to accommodate normal manufacturing equipment capabilities at acceptable manufacturing cost levels. This is a particular problem in producing carburetors for engines for chain saws, lawn mowers, clearing saws, weed whips, etc. that require very low manufacturing cost due to the low retail price of such consumer products. The problem is compounded due to the small size of the carburetors for such small engines, and the corresponding minuscule size of the choke and throttle parts involved in the carburetor mechanisms. These factors make it particularly difficult to reduce manufacturing tolerance allowances in order to reduce the adverse effects of unavoidable manufacturing dimensional variations in such tiny parts when assembled for operation in the mechanism.

Thus, in the case of the incomplete and/or inconsistent closure of the choke valve in the operation of the fast idle starting system of the '480 patent arrangement, it has been found that a shift in tolerances for all parts (tolerance stack-up) in the latch mechanism to one end limit will render the choke valve incapable of reaching the fully closed position. This prevents, or at least hinders engine starting. On the other hand, a tolerance shift in all of these parts to the opposite end limit will cause the fast idle lever to fail to even engage with the throttle lever, so that no "latch up" action occurs. This results in a loss of function of the entire choke throttle fast idle system.

The culprit in this problem has been found to be the push coupling, via tang 14, between the choke lever 12 and fast idle lever 9. This dictates that the actual position of choke valve 10 when swung toward closed position will be controlled by the latched up position of fast idle lever 9 when the engaged throttle lever latch tang 7 and fast idle lever notch 8 of the latch system (if indeed engaged) swing slightly back to their spring held, stable, latched position after manipulating forces are removed from the manual controls of the appliance, as will be explained and seen in more detail hereinafter in conjunction with FIGS. 8–13.

Another prior art solution to the problem of achieving automatic fast idle setting of the throttle valve is found in Hermle U.S. Pat. No. 5,200,118, issued Apr. 6, 1993 and assigned to Walbro Corporation of Cass City, Mich., assignee of record herein. A fast idle throttle latch system with automatic release in accordance with the '118 patent is shown in FIGS. 4, 5, 6, 7A and 7B in the drawings herein, which correspond respectively to FIGS. 5, 3, 2, 1, and 4 of the '118 patent. Again, for convenience the reference numerals employed in FIGS. 4–7B herein are those appearing in such drawing figures of the '118 patent, to which reference may be had for further details of construction and operation (U.S. Pat. No. 5,200,118 also being incorporated herein by reference).

It will be seen from FIGS. 4–7B herein, and by reference to the specification and claims of the '118 patent, that the choke valve 10 is "divorced" as to its operator control handle 16 and associated linkage from the control handle 28 and associated linkage for the fast idle lever 20, which is thus independently operated through its own crank arm 24 of its bell crank 20. The '118 system thus provides a separate manual control 16 to operate the choke valve 10, and likewise the fast idle latch lever 20 is operated solely by actuating its own control member 28. For convenience to the operator, these two separate actuating members 16 and 28 are associated in their physical location so that they can be easily conjointly manipulated ganged as one unit, if desired, or individually and separately manipulated, as will be seen in FIGS. 4 and 7A. It will be seen that with the '118 patent system there is no tang coupling between choke lever arm 12 and the fast idle latch bell crank 20 and hence the '118 patent system does not present the aforementioned incomplete choke closure problem of the '480 patent system. This is because the latched-up position of bell crank 20 does not affect or in any way hinder complete closure of choke valve 10, when it is individually manipulated to this condition by its own actuating control 16. Likewise setting bell crank 20 with handle 28 in order to latch up with throttle lever 8 in no way affects choke valve 10. Nevertheless, as in the '480 patent system, when the chain saw engine has been started, and then the throttle trigger depressed, the fast idle lever will be automatically disengaged to allow spring return to its at rest position as shown in FIGS. 4 and 7B.

It should be noted that at some point in time subsequent to the issuance of the '118 patent, a running change was made in the production of carburetors embodying a '118 patent control mechanism. In order to enable setting of the fast idle bell crank latch 20 with the actuating handle 28 adjustably set in a range of "latch-up" positions, several relatively large notches were provided on the free end edge of bell crank arm 22 in place of the single notch 21 referenced in FIG. 4. These notches were designed to be individually engaged by free end edge 23 of throttle lever 8 to set the throttle valve 6 in the fast idle position of FIGS. 5 and 6 regardless of in which of these inner end limit positions the actuating handle 28 was set.

Nevertheless, the aforementioned prior art neither addresses the problems nor provides a solution thereto that insures that, in the case of the '480 fast idle mechanism, as manufactured in mass production practice, the choke will be able to reach the fully closed position at fast idle latch-up. Therefore, the problems of poor starting, or in worst case, "no starting", have continued to prevail for many years despite the wide spread use of the '480 system on carburetors supplied by several major carburetor manufacturers utilizing the '480 system.

These problems resulting from incomplete and/or inconsistent closure of the choke valve in the fast idle starting system of the '480 patent will be better understood by referring to layouts of the choke valve and throttle valve and actuator levers as set forth in FIGS. 8–13 herein.

FIGS. 8, 9 and 10 are vertically arrayed in alignment and illustrate a layout developed in pursuing the invention herein to better analyze the foregoing problems involved in the construction and operation of a commercial embodiment of the '480 fast idle system, wherein parts alike to those in the '480 patent are given like reference numerals. This system layout thus shows throttle valve plate 1, throttle lever 4, fast idle lever 9, choke valve plate 10 and choke lever 12. Throttle plate 1 and throttle lever 4 are mounted on throttle shaft 2 for rotation therewith, and choke lever 12 is mounted on and keyed for rotation with choke shaft 11 for rotating choke plate 10. Fast idle lever 9 is journalled on choke shaft 11 for free rotation relative thereto. Dimensions B, C and D respectively define the width of the carburetor casting body, the center-to-center distance between shafts 2 and 11 and the distance of the center of shaft 2 from the outlet face of the carburetor body.

Dimension E (FIGS. 9 and 12) represents the gap between the free end edge of tang 7 of throttle lever 4 as spaced from surface 8*a* of notch 8 of fast idle lever 9, with tang 7 resting on face 8*b* of notch 8 when choke shaft 11 has been rotated by choke lever 12 to the full closed choke position shown in FIG. 9 by manual force operator-applied to the choke operating cable (not shown). FIG. 10 illustrates the position of the parts when operator actuating force is released from choke lever 12 and the parts are allowed to "back up" (retrograde rotation) and thereby assume their fully latched engaged position as held solely by the biasing forces of their respective return springs.

It is to be noted that FIGS. 8, 9 and 10 represent the operation of the parts when manufactured to "nominal" design dimensional specifications, i.e., using the mean dimensional value of each present production part as presently print specified using the tolerance variation presently allowed in the parts, and thus represents an idealized condition for current production. It will thus be seen that fast idle arm 9 is swung from its rest position in FIG. 8 by control linkage pulling on choke lever 12 to rotate the same counter-clockwise as viewed in FIGS. 8–10. Choke lever 12, through its engagement with tang 14 of the fast idle lever 9, thus swings lever 9 from the FIG. 8 position counter-clockwise so that the lever free end leading edge 9*a*, in advance of notch 8, first engages tang 7 of throttle lever 4 prior to notch 8 reaching the FIG. 9 position wherein tang 7, acting as a detent, has sprung into notch 8. Lever 9 continues this counter-clockwise swing through the FIG. 10 position, wherein tang 7 is still detent engaged in notch 8 and is now abutting notch surface 8*a*, and then completes its operator-driven swing when the parts reach the position of FIG. 9, wherein the corresponding swing of choke valve plate 10 is positively stopped by the protruding portion of its peripheral edge striking the carburetor throat bore surface.

Note that the design layout of FIG. 9 calls for the choke plate 10 being positively stopped in fully closed position at an angle of 15° from a design plane PC that intersects perpendicularly the throat axis X of the carburetor. This interengaged latching position will be achieved by operator manual force applied to the control cable attached to choke lever 12 working against the bias of the return spring (not shown) acting on lever 9, and against the bias of the return spring (not shown) acting on throttle lever 4.

However, note that when the operator releases his control manipulating force, the return springs will retrograde pivot levers 9 and 4 from the FIG. 9 position back to the FIG. 10 position. The FIG. 10 position thus represents the nominal (idealized) fully latched-up condition with the throttle valve plate 1 is solely spring held in fast idle position and the choke valve plate 10 is solely spring-held in nominal fully closed position by the fast idle latch system. It will be seen that the dimension of gap E enables 3° of retrograde pivotal motion of the latch parts from the FIG. 9 to the FIG. 10 position, thereby allowing the return springs to move the throttle valve plate 1 from an inclination of 31° (FIG. 9) to an inclination of 28° (FIG. 10) relative to a design plane PT coincident with the axis of shaft 2 and perpendicularly intersecting the carburetor throat axis X. More significantly, choke valve plate 10 will swing back open through an angle of 3° from the 15° position shown in FIG. 9 to the 18° inclination position of FIG. 10. However, this FIG. 10 very slightly open position of choke valve plate 10 nevertheless has hitherto been accepted as functionally filly closed for achieving existing carburetor design optimum performance.

FIGS. 11, 12 and 13 are layouts corresponding to FIGS. 8, 9 and 10 respectively and in which the moving parts of the fast idle latch system are laid out on the same scale as FIGS. 8, 9 and 10, but are all theoretically made to one limit of their dimensional tolerances to represent one extreme of the design tolerance stack-up. It will be seen that dimension E in FIG. 12 is substantially greater than the corresponding dimension E in FIG. 9. It will also be seen that the fast idle lever 9 engages tang 7 earlier in its path of swing travel during choke closure, as illustrated by the relative angulation of the parts in FIG. 13 as compared to FIG. 10. Lever 9 finally reaches the stop limit position of FIG. 12 when choke plate 10 is forced against the surface of the carburetor bore in its actual fully closed position, and hence is again inclined at an angle of 75° from the carburetor throat axis X. Then when operator manual force is released from the control actuating member, the biasing forces of the return springs acting on levers 4 and 9 pivot the same back from the position of FIG. 12 to the fully engaged, solely-latch-held position of FIG. 13.

It will be seen that the tolerance stack-up gap E of FIG. 12 thus now enables choke plate 10 to pivot out to a position inclined at 25° from plane PC, which is a full 10° farther open from fully closed position of FIG. 12. Likewise, throttle plate 1 now has pivoted to a fast idle position inclined at 26° from plane PT, which is 2° more closed than the corresponding nominal 28° design position of FIG. 10. Thus allowing choke valve 10 to remain partly so opened, and throttle plate 1 more closed than desired, in their respective latched-up condition causes some level of performance degradation, ranging from starting difficulty to failure to start. Accordingly, inadequate starting A/F enrichment functioning of such valve plates thus results when the parts are made to the tolerance stack-up of FIGS. 11–13.

On the other hand, at the other extreme of design tolerance stack-up (not illustrated), the choke valve plate 10 will reach the fully closed stopped position (75° of rotation from fully open) before tang 7 of throttle lever 4 has even engaged any free end edge surfaces of fast idle lever 9. Hence, at this other tolerance limit the result is a complete failure of the fast idle system to function.

By way of example and not by way of limitation, the dimensional values employed for the foregoing analysis illustrated in FIGS. 8–13 were as follows (wherein the parts are shown to engineering scale and, for example, dimension B is 33.66 mm in the nominal case):

| | DIMENSIONAL VALUE | |
|---|---|---|
| NAME OF PART | Nominal | Worst Case |
| Width of casting dimension B | 33.66 mm | 33.28 mm |
| Center-to-Center distance between shafts 2 and 11 | 24.00 mm | 24.12 mm |
| Dimension D | 6.35 | 6.47 |
| Choke Lever l2 | 2.50 | 2.62 |
| Fast Idle Lever 9 | 3.8 | 3.6 |
| | 17.55 | 17.45 |
| | 55° | 56° |
| Throttle Lever 4 | R 8.0 | 7.8 |
| | 13.00 | 12.83 |
| Choke Shaft 11 | 4.72 | 4.69 |
| | 2.06 | 2.11 |
| Choke Shaft Assembly | 55° | 58° |

OBJECTS OF THE INVENTION

Accordingly, among the objects of the invention are to provide an improved carburetor choke and throttle mechanism providing automatic throttle fast idle setting capability that obtains the advantages of the Johansson patent U.S. Pat. No. 4,123,480 system as compared to the alternative system of the Hermle patent U.S. Pat. No. 5,200,118, while at the same time overcoming the aforementioned problems encountered in mass production of carburetors employing the '480 patent system so that when the parts are made to the existing entire range of dimensional tolerances the fast idle lever will nevertheless properly engage the throttle lever in such a manner that the choke valve plate will move to, and remain in, the fully closed position, thereby eliminating the poor starting or worse case, no starting, conditions described herein above.

Another object of the invention is to provide an improved carburetor choke and throttle automatic fast idle mechanism of the above character which solves the aforementioned problems by replacing a minimal number of parts with an improved choke shaft and choke valve plate subassembly, at less cost than that of the replaced parts, and one that can be substituted as a running change in production, that does not significantly alter the manufacturing and assembly processes already employed in the manufacture of the prior mechanism, which is readily retrofitable to existing carburetors as a field repair item if desired, and which does not require any tightening up of existing manufacturing tolerances and thus avoids the additional costs of attempting to achieve such improved precision in processing methods and machinery as well as assembly equipment and fixturing.

SUMMARY OF THE INVENTION

In general, and by way of summary description and not by way of limitation, the invention fulfills the foregoing objects by merely substituting only a novel choke shaft, choke valve plate, choke lever and fast idle lever subassembly for the corresponding prior art parts, the remaining throttle lever part of the carburetor automatic fast idle control mechanism being retained and utilized without change. In one preferred but exemplary embodiment, the choke shaft is made from a torsionally flexible material, such as Delrin® acetal plastic, that can be torsionally stressed to enable continued rotation of the shaft portion carrying the fast idle lever after the choke valve reaches full closure. Hence further pivotal motion of the fast idle lever is produced before it reaches latch up engagement with the throttle lever.

A spring biased, lost motion operating linkage for the choke valve and fast idle lever is thus achieved that prevents retrograde opening motion of the choke valve from its fully closed design position upon release of operator actuating force. This is achieved regardless of variations in the angular range of relative orientation of the fast idle lever free end with respect to the tang of the throttle lever throughout the range of tolerance stack-up positions of these parts as well as the remaining operably cooperative mechanism parts when mass produced to the pre-existing tolerance specifications. The override capability of the choke shaft thus insures complete choke valve closure without concern for the required manufacturing tolerances.

BRIEF DESCRIPTION OF THE DRAWINGS

The foregoing as well as other objects, features and advantages of the present invention will become apparent from the following detailed description of the best mode, appended claims and accompanying drawings (which are to engineering design scale unless otherwise indicated) in which:

FIG. 31 is a front elevational view,

FIG. 32 is a side elevational view of the left hand side of the carburetor as viewed in FIG. 31, FIG. 33 is a projection in a plane perpendicular to the choke shaft to thereby provide a fragmentary elevational view of the right hand side components of the carburetor of FIG. 31, FIG. 34 is a side elevational view of the right hand side of the carburetor as viewed in FIG. 31, FIG. 35 is an elevational view of the rear side of the carburetor of FIG. 31, FIG. 36 being a bottom plan view of the carburetor of FIG. 31, and FIG. 37 is a side elevational view of the throttle lever of the latch mechanism of the carburetor of FIGS. 32–36.

DETAILED DESCRIPTION OF THE PREFERRED EMBODIMENTS OF THE INVENTION

Figure 1:
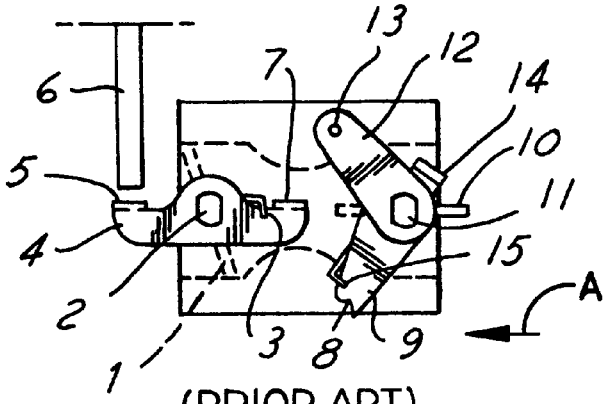
(PRIOR ART) FIG. 1
FIGS. 1–3 are views corresponding to FIGS. 1, 3 and 4 respectively of Johansson U.S. Pat. No. 4,123,480.
Figure 2:
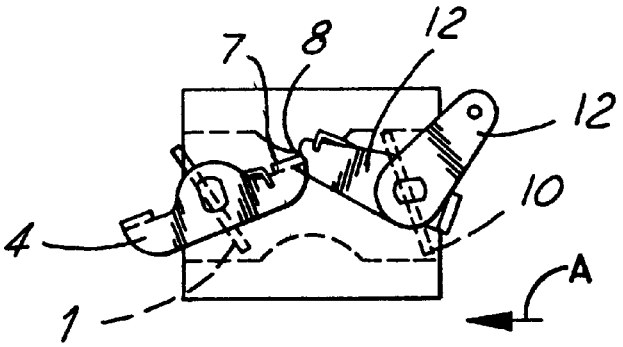
(PRIOR ART) FIG. 2
Figure 3:
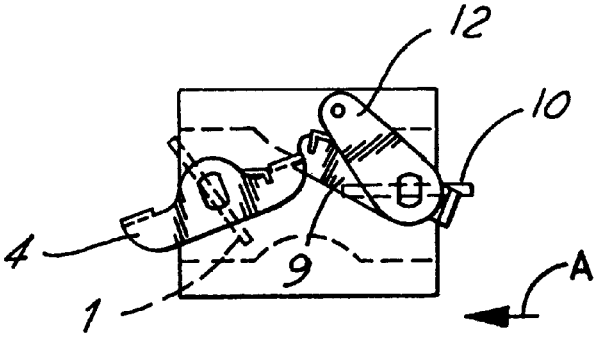
(PRIOR ART) FIG. 3
Figure 4:
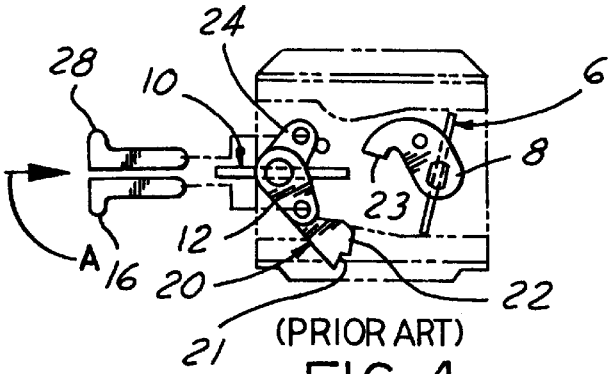
(PRIOR ART) FIG. 4
FIGS. 4, 5, 6, 7A and 7B are views corresponding respectively to FIGS. 5, 3, 2, 1 and 4 of Hermle U.S. Pat. No. 5,200,118.
Figure 7A:
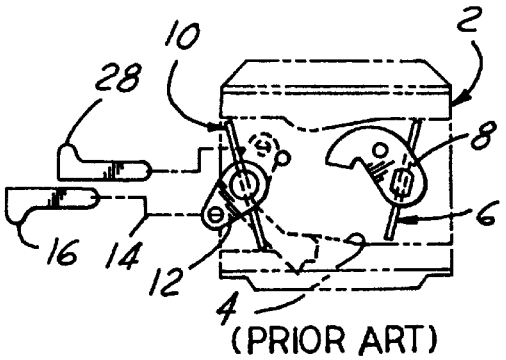
(PRIOR ART) FIG. 7A
Figure 5:
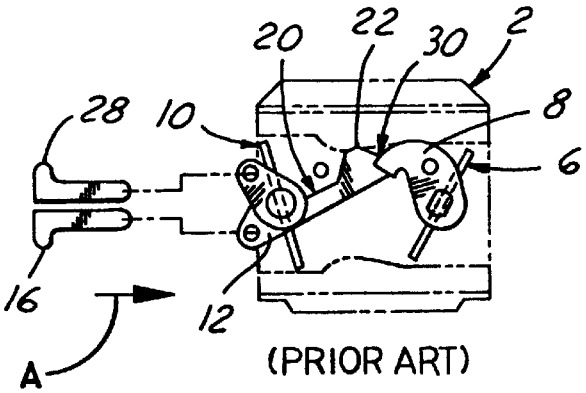
(PRIOR ART) FIG. 5
Figure 7B:
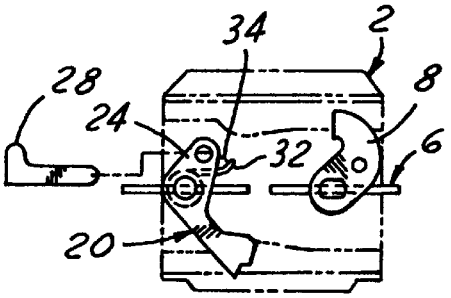
(PRIOR ART) FIG. 7B
Figure 6:
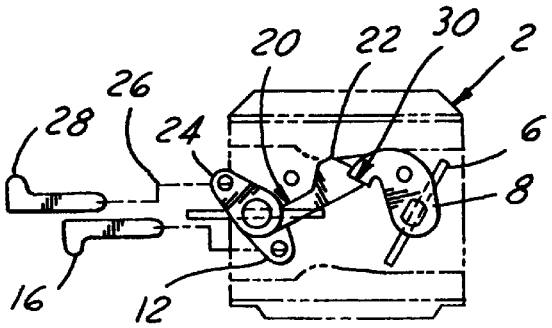
(PRIOR ART) FIG. 6
Figure 8:
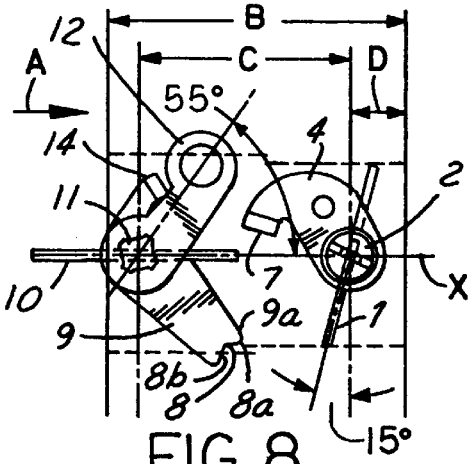
FIGS. 8–10 are sequential design layout views of commercial embodiment components employed in the prior art system of FIGS. 1–3 as designed to a nominal mean of the existing production tolerances to illustrate the best hitherto achievable cooperation of these existing parts in assembly and operational positions.
Figure 11:
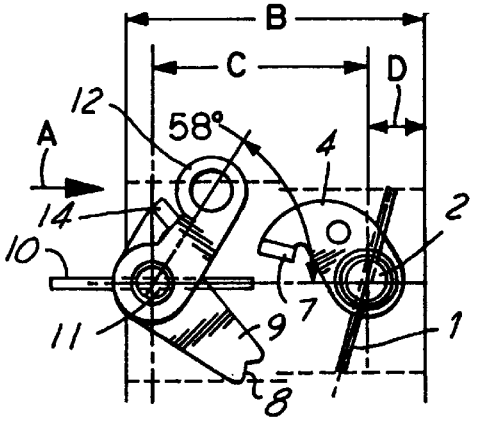
FIGS. 11, 12 and 13 correspond respectively to FIGS. 8, 9 and 10 but illustrate the same parts when designed to one extreme of worst case present manufacturing tolerance limits to illustrate resultant incomplete closure of the choke valve when the parts are so manufactured.
Figure 9:
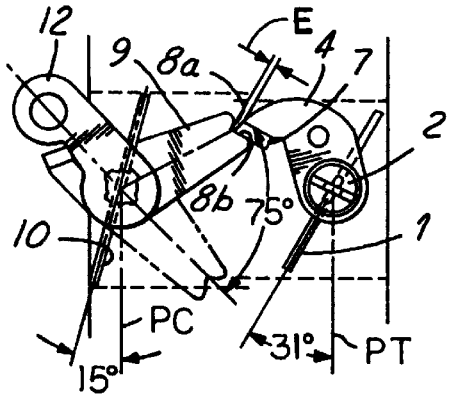
Figure 12:
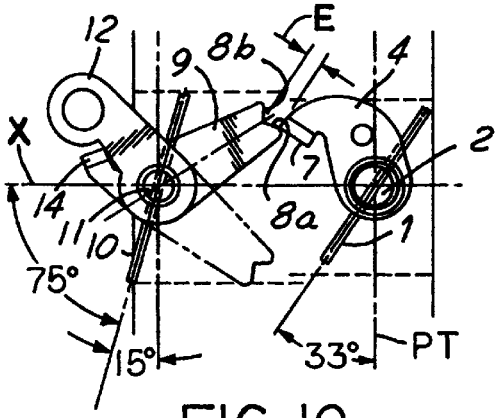
Figure 10:
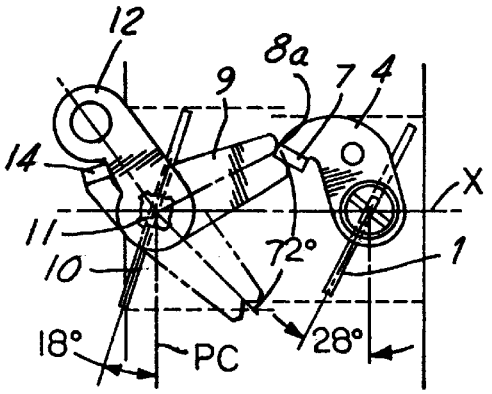
Figure 13:
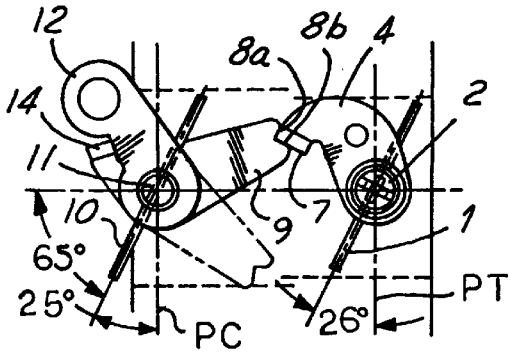

Referring in more detail to the accompanying drawings, FIGS. 14–30 illustrate the components of the improved throttle-choke automatic fast idle throttle setting mechanism of the invention. The system of FIGS. 14–30 employs some of the same component parts and operates generally in the same, albeit improved, manner as the prior art construction described previously conjunction with FIGS. 1–3 and 8–13. Hence, like reference numerals are employed to identify like parts and their description not repeated with reference to FIGS. 14–30. Likewise, the exploded perspective view of FIG. 14 and the carburetor assembly views of FIGS. 31–36 illustrate the improved carburetor throttle and choke fast idle automatic latch mechanism of the invention as adapted for installation in a modem small engine carburetor 50 of known construction. Hence, the structure, function and mode of operation of carburetor 50 will be understood by those skilled in the art from the views of FIGS. 14 and 31–37 and thus for brevity not further described herein.

Figure 14:
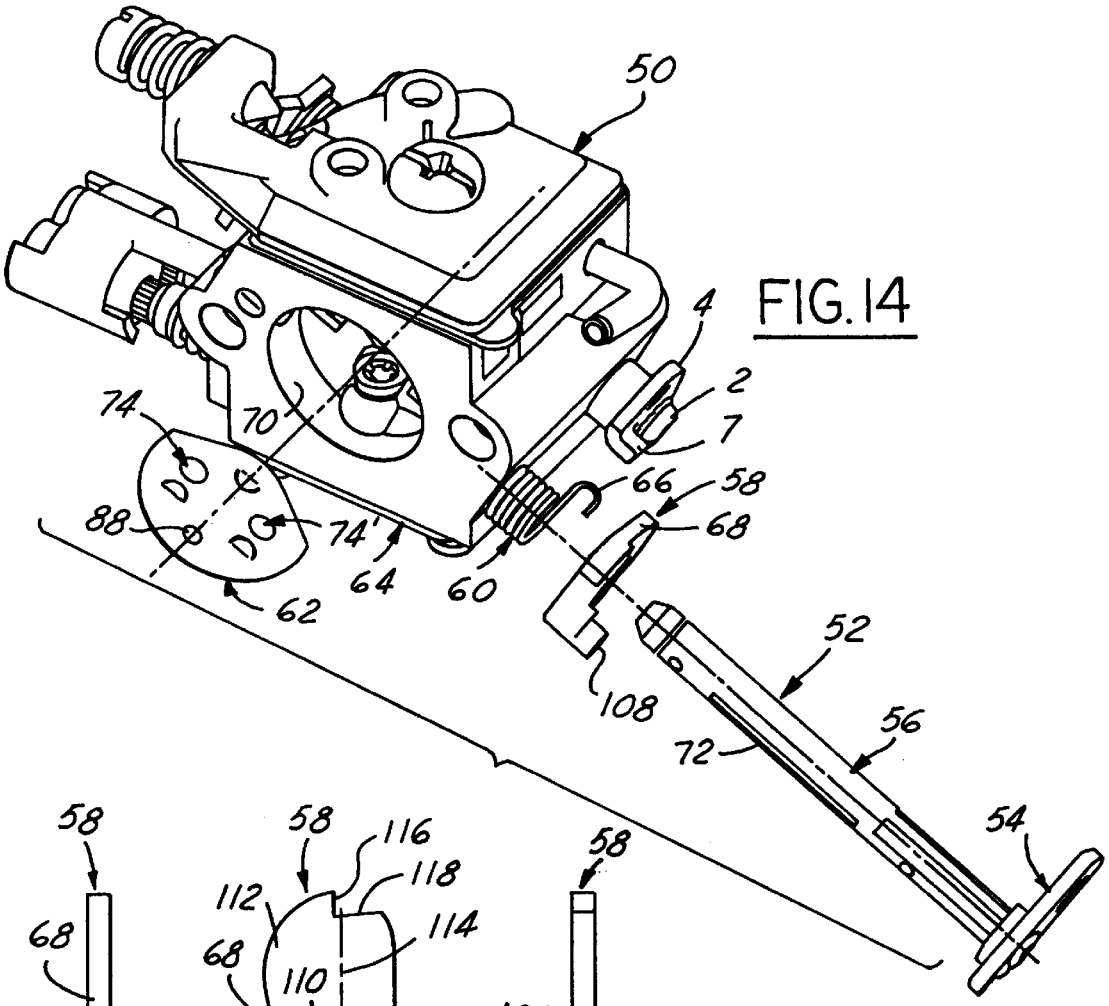
FIG. 14 is an exploded perspective view of a small engine carburetor incorporating the improved carburetor throttle and choke fast idle automatic latch mechanism of the invention.
Figure 15:
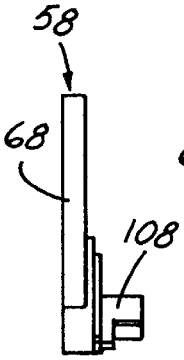
FIGS. 15, 16 and 17 are respectively front, side and rear elevational views of the fast idle lever of the mechanism shown by itself.
Figure 16:
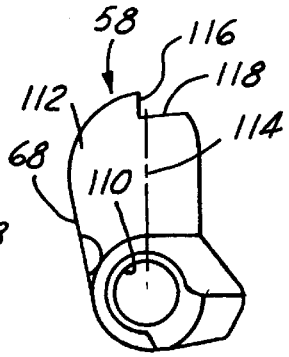
Figure 17:
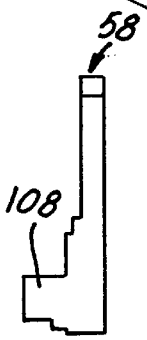

As best seen in FIG. 14, the improved carburetor throttle and choke fast idle automatic latch mechanism of the invention, in the embodiment illustrated in the foregoing drawing figures, comprises a combination choke shaft and choke lever part 52 preferably in the form of the choke lever 54 integrally joined to the right hand end of a torsionally flexible choke shaft 56 by being injection molded as one piece therewith. ("Integral" as used herein means joined or united by being molded in one piece.) The latch mechanism further includes a fast idle latch lever 58, a latch-biasing coil spring 60 and a choke valve plate 62.

Figure 30:
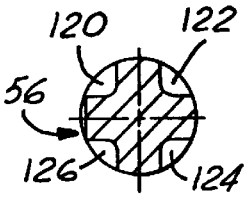
Figure 31:
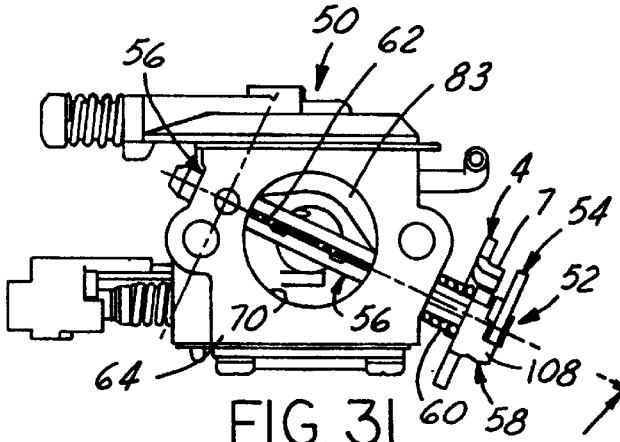
FIGS. 31 through 37 are reproductions from engineering scale drawings of a prototype carburetor embodying the improved carburetor throttle and choke fast idle automatic latch mechanism of the invention as illustrated in FIGS. 14–30, and constitute views as follows.
Figure 32:
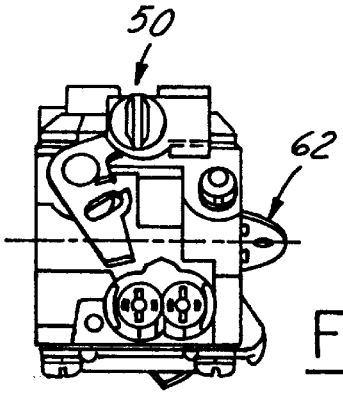
Figure 33:
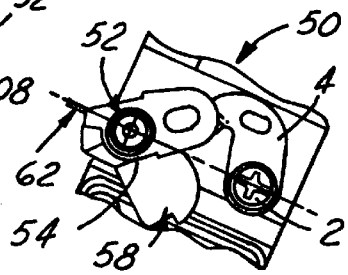
Figure 34:
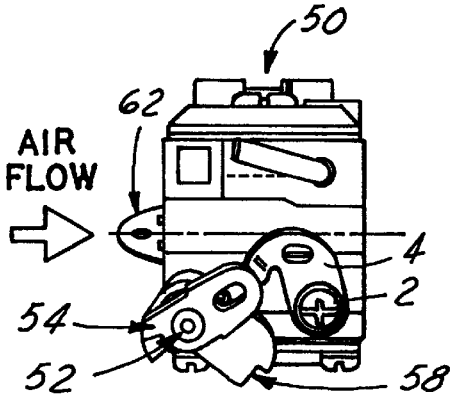
Figure 36:
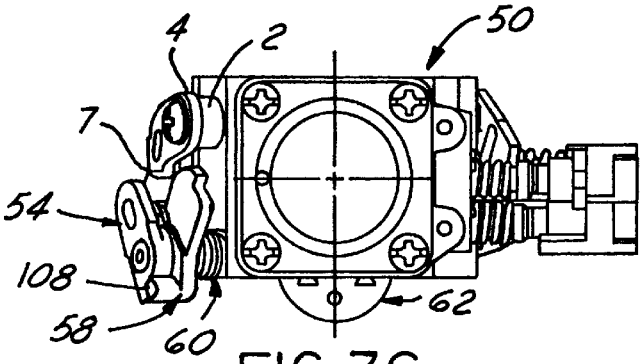

The choke shaft/choke lever part 52 in a preferred embodiment is constructed pursuant to the engineering scale views of FIGS. 21 through 30, which are incorporated in this description by reference, and incorporates certain novel features described in detail hereinafter. The fast idle latch lever 58 is constructed pursuant to the engineering scale views of FIGS. 15, 16 and 17 and such are also incorporated into this description by reference and lever 58 not further described in detail. Coil spring 60 is similar to the latch mechanism springs of prior carburetors and encircles choke shaft 56 in assembly therewith as shown in FIGS. 31 and 36. Spring 60 has a hook tang termination (not shown) of its inboard convolution that is inserted in an anchoring hole (not shown) provided in the carburetor body casting 64. The outboard convolution of spring 60 has a hook tang 66 that hooks over an edge 68 of fast idle lever 58, as seen in FIGS. 34 and 36. Choke valve plate 62 is made to the engineering scale of the engineering detail views of FIGS. 18, 19 and 20 and such are incorporated into this description by reference.

The combination choke shaft/choke lever part 52 is preferably manufactured as an injection molded part from suitable high strength plastic material that nevertheless has a slight resilience characteristic, preferably Delrin® 500 acetal plastic material, and is made to the scale as shown in detail of FIGS. 21–30. Note that the portion of shaft 56 that registers with the carburetor throat bore 70 in assembly therewith is provided with a through slot 72 (FIGS. 14, 23 and 29) coincident with the central longitudinal axis of the shaft. Slot 72 is dimensioned to slidably and resiliently yieldably receive therethrough choke plate 62 with an interference fit. Choke plate 26 thus has a snap-in slot mount in assembly in choke shaft 56.

Figure 18:
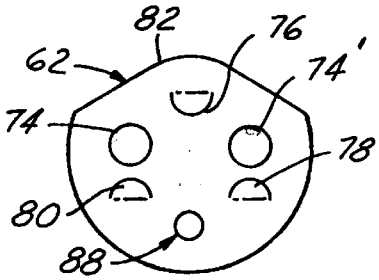
FIGS. 18 and 19 are respectively front elevational and side elevational views of the improved choke valve plate employed in the preferred embodiment of the invention, and shown by itself.
Figure 19:
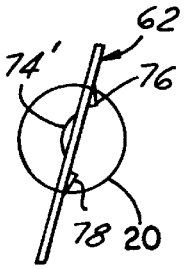
Figure 20:
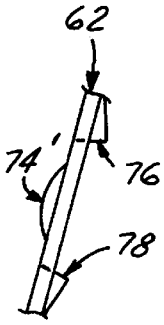
FIG. 20 is an enlarged fragmentary view of the portion encompassed by the circle 20 in FIG. 19.

As best seen in FIGS. 18–20, plate 62 is provided centrally with two dimples 74,74'. Two dimples 74,74' ensure an interference fit of plate 62 within slot 72 and thus produces a slight resilient stress bulge in shaft 52 upon assembly of plate 62 through slot 72. The upper edge 82 of plate 62 has a modified V-shape to accommodate closure fit of this edge of the plate, in choke valve-closed position, with a so-called "droopy eye" protrusion 83 (FIG. 31) of body casting 64 that extends into the upper region of the carburetor throat bore 70 in the region of choke plate 62 in assembly therewith. Preferably, plate 62 is inserted in slot 72 with edge 82 being the leading edge. Plate 62 is further retained with a snap-in type fit in assembly in slot 72 by three detent tangs 76, 78 and 80. Each of these detents is formed as a semi-circular displacement of the metal or material of plate 62 from its major plane into an inclined ramp without thereby rupturing the material of the plate. Hence forming of the detent ramps in this manner does not provide an air leak path through the choke valve plate.

Figure 41:
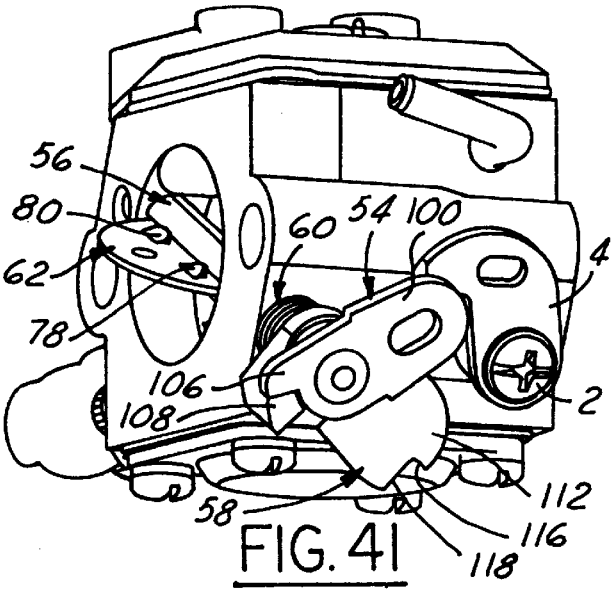
FIGS. 41, 42 and 43 are computer generated simplified perspective views illustrating the carburetor as shown in FIGS. 14–37, with the carburetor throttle and choke fast idle automatic latch mechanism sequentially illustrated in the three operative positions corresponding respectively to the design layout views of FIGS. 38, 39 and 40.
Figure 42:
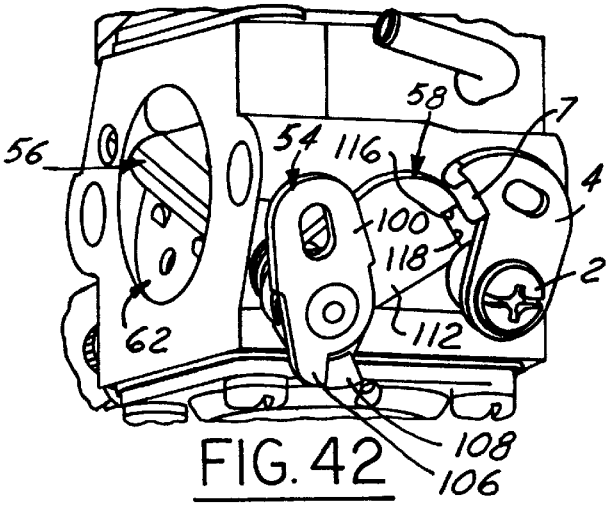
Figure 43:
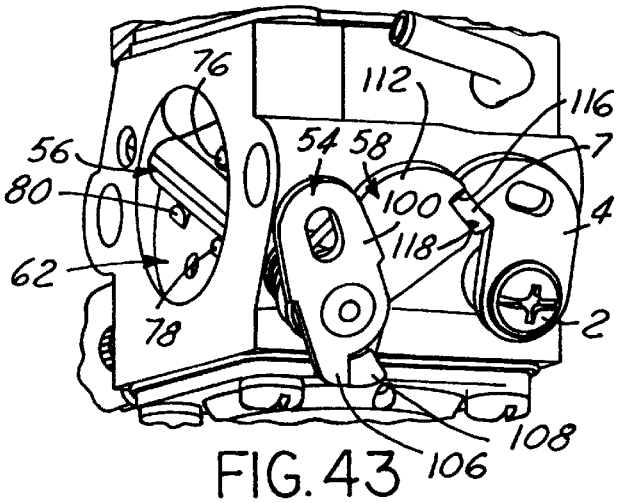

As best seen in FIG. 43, after insertion of plate 62 to fully installed condition on shaft 56, the dimples 74,74' are centered in the slot 72. During installation, the material of shaft 56 flexes sufficiently to enable leading detent 76 to pass through slot 72. Then this shaft resilience causes the slot to close sufficiently so that the trailing ramps 78 and 80 come into abutment with the slot edges on the opposite side of the shaft. Likewise, such slot closure prevents retrograde travel of detent 76 back through shaft 56. Choke plate 62 is thus detent-dimple-captured in assembly with the choke shaft as shown in FIGS. 41–43. An air metering hole 88 is also provided in choke plate 62 in accordance with conventional practice.

As best seen in FIGS. 21–26, choke lever 54 is molded integrally with the outboard end of shaft 56 and has an arm 100 with a slot 102 for coupling to the conventional choke actuating linkage (not shown) provided for carburetor 50. Lever 54 also has a short finger 106 protruding diametrically oppositely from arm 100 that cooperates with the laterally protruding tang 108 of fast idle lever 58 (FIGS. 14–17) in the manner illustrated in the sequential views of FIGS. 41–43 (the diagrammatic equivalent thereof being shown in FIGS. 38–40, respectively).

Fast idle lever 58 has a cylindrical bore 110 that receives shaft 56 therethrough to journal lever 58 for free rotation on the shaft. Tang end 66 of spring 60 hooks over edge 68 of lever 58 to yieldably spring bias lever 58 in a clockwise direction as viewed in FIGS. 14, 33, 34 and 41–43. A main blade portion 112 of lever 58 terminates in a camming radius portion 114 of edge 68 that is interrupted by a latch notch formed by notch edge surfaces 116 and 118 corresponding to surfaces 8*a* and 8*b* of fast idle lever 9 in the schematic diagrams of the prior art arrangement of FIGS. 8–13. The camming/latch-up engagement with tang 7 of throttle lever 4 is illustrated schematically in FIGS. 38–40 and in actual practice in the carburetor construction illustrated in the views of FIGS. 41–43. The automatic setting of the throttle valve plate 1 in the start position of FIG. 40 is caused by the fast idle lever 58 being rotated counterclockwise by choke lever 54 when it in turn is likewise rotated to rotate choke valve plate 62 counterclockwise from the wide open position of FIG. 38 to the start/close position of FIGS. 39 and 40, as will be understood, in general, from the foregoing discussion of the Johansson patent U.S. Pat. No. 4,123,480 discussed with reference to FIGS. 1–3 and 8–13.

Figure 38:
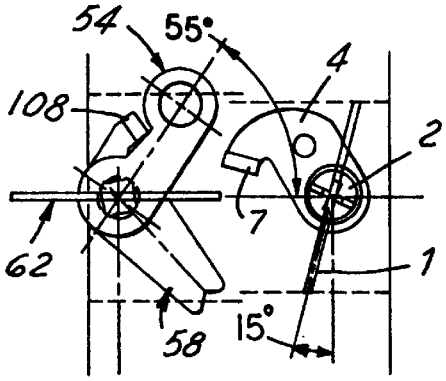
FIGS. 38, 39 and 40 are design layout views (respectively corresponding to FIGS. 8, 9 and 10) of the improved carburetor throttle and choke fast idle automatic latch mechanism of the invention respectively illustrating the fully opened and fully closed positions of the choke valve, and the fully closed (low speed) and fast idle positions of the throttle valve when manufactured to nominal (mean) design tolerances corresponding to those employed in the layout illustration of the prior commercial system in FIGS. 8–10.
Figure 39:
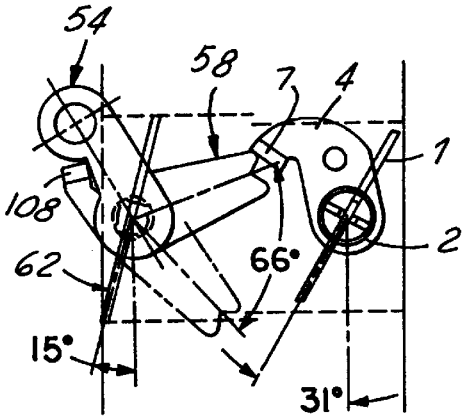
Figure 40:
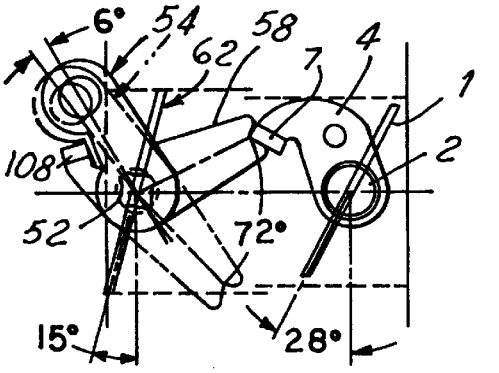

However, in accordance with a principal feature of the present invention, the choke actuating linkage (not shown) hooked to slot 102 of arm 100 of choke lever 54 is suitably adjusted so that when it is manipulated to thereby actuate lever 54 from the choke open position of FIGS. 38 and 41 to the initial fully closed position of choke plate 62 shown in FIGS. 39 and 42, the actuating linkage does not arrive at the "full choke" control setting until choke lever 54 has been swung counterclockwise (as viewed in FIGS. 39–43) through the initial-choke-closed position of FIGS. 39 and 42 to the full override position shown in phantom in FIG. 40. Since choke plate 62 is positively stop-engaged at its periphery with the surface of the carburetor bore 70 when it reaches the initial-choke-closed position of FIGS. 39 and 42, it cannot rotate counterclockwise any further than this stop position. Hence corresponding further counterclockwise rotation of shaft 52 is likewise resisted by this bore-engagement stoppage of choke plate 62.

Figure 21:
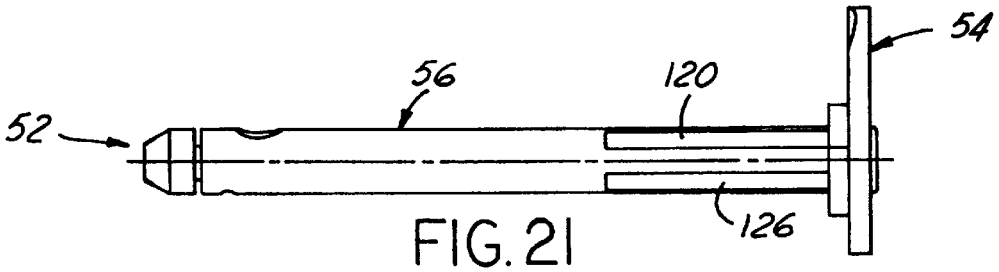
FIG. 21 is a top plan view of the improved choke shaft and choke lever part of the assembly shown by itself.
Figure 23:
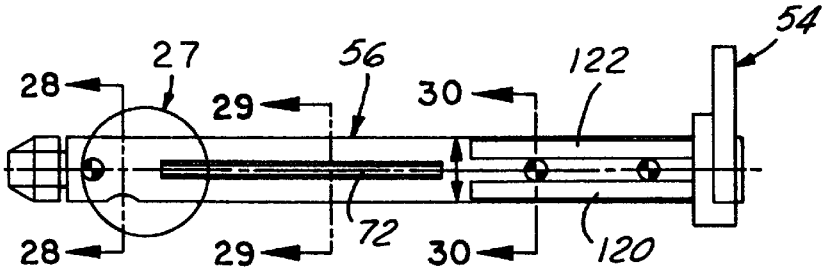
FIGS. 22, 23 and 24 are respectively left hand end elevational, side elevation and right hand end elevational views of the choke shaft/choke lever part.
Figure 22:
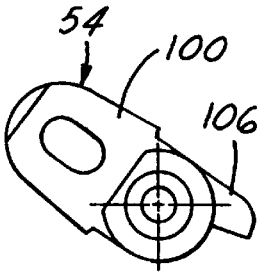
Figure 24:
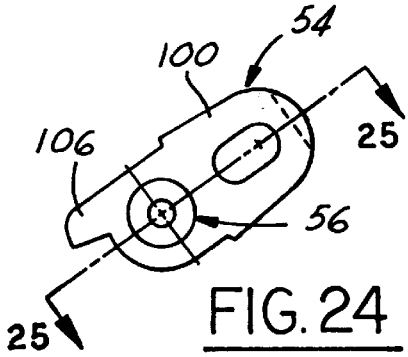
Figure 27:
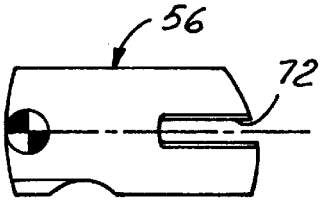
FIG. 27 is a fragmentary enlarged view of the portion encompassed by the circle denoted 27 in FIG. 23.
Figure 26:
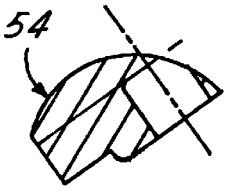
FIG. 26 is a greatly enlarged view of the portion of FIG. 25 encompassed by the circle 26 therein.
Figure 25:
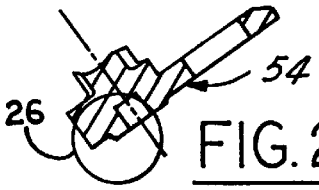
FIG. 25 is a fragmentary cross sectional view taken on the line 25—25 of FIG. 24.
Figure 28:
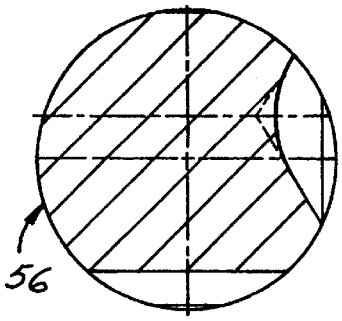
FIGS. 28, 29 and 30 are cross sectional views taken respectively on the lines 28—28, 29—29 and 30—30 of FIG. 23.
Figure 29:
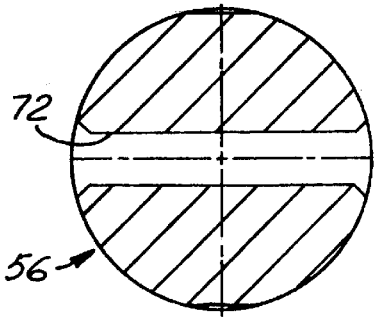

Nevertheless, due to choke shaft 56 being made from torsionally resiliently flexible material, the same can and does twist about its longitudinal axis as it is being torsionally stressed by the torque applied via choke lever 54 to the outboard end of shaft 52 during the 6° override travel motion of lever 54 from its FIG. 39 to its FIG. 40 phantom position (FIG. 42 to FIG. 43 positions). This override twisting stress and resultant twisting strain in shaft 52 occurs primarily between the outboard end of slot 72 and lever 54. In this regard, it will be noted that torsional flexibility in this lengthwise axial outboard portion of shaft 56 is enhanced by the material removal resulting from formation of four longitudinally extending grooves 120, 122, 124 and 126 spaced 90° angularly from one another in shaft 56, as best seen in FIGS. 21, 23 and 30.

This shaft torsional flexibility thus enables continued, override rotation of the outboard portion of shaft 56 carrying fast idle lever 54 after choke valve 62 initially reaches full closure (FIGS. 39 and 42). Hence, corresponding override pivotal motion of fast idle lever 58, as the same continues to be pushed by tang 106 of lever 54 during such choke linkage actuation, carries notch edge 116 of plate 112 of lever 58 in its travel path counterclockwise past the lock-up end edge 130 of tang 7 of throttle lever 4. This latch-up override occurs during the approximately 6° preferred angular range of override rotation of the outboard end of shaft 56 as lever 54 continues its counterclockwise pivotal motion from its position in FIG. 39 to its phantom line position in FIG. 40. Therefore, despite tolerance stack ups in the manufacture of these parts causing deviation from their nominal design latching orientation condition, the override will insure that tang 7 can and will drop onto surface 118 of the notch prior to release of operator actuating force on lever 54, and edge 130 of tang 7 will thereafter lock-abut notch surface 116 of plate 112 after release of operator actuating force on lever 54. It thus will be seen that overtravel of lever 54, permitted by twisting of the resilient shaft 56, forms a preferred embodiment of a spring biased, lost-motion coupling in the operating linkage for the choke valve and fast idle lever.

This latch-up-during-override feature also prevents retrograde opening motion of choke valve plate 62 from its fully closed design position, upon release of operator actuating force, due to the latched-up condition of lever 58 and throttle lever 4 (FIGS. 40 and 43). This is achieved regardless of variations in the angular range of relative orientation of the fast idle lever free end notch surfaces 116, 118 with respect to edge 130 of tang 7 of throttle lever 4 throughout the range of tolerance stack-up positions of these parts, as well as that of the remaining operably cooperative mechanism parts, when such components are mass produced to the aforementioned pre-existing tolerance specifications. This override capability of choke shaft 56 thus ensures complete choke valve closure without concern for the required manufacturing tolerances.

Figure 35:
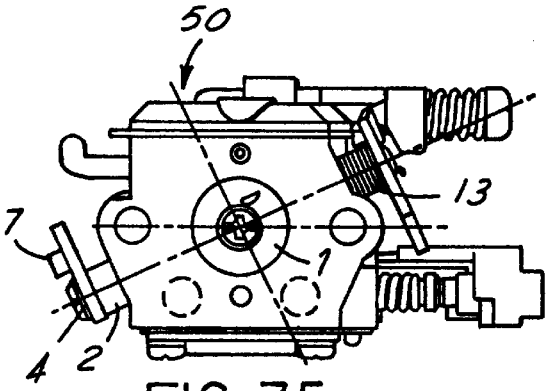
Figure 37:
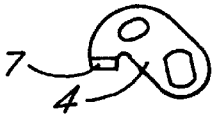

After engine start-up and upon operator actuation of throttle lever 4 through manipulation of the throttle control linkage coupled to lever 4 (not shown), and as throttle plate 1 is thereby being swung clockwise out of the start position of FIGS. 40 and 43 (to which is rotationally biased by throttle shaft spring 13, FIG. 35), tang 7 is swung out of latch engagement with the free end of lever 58. This then allows choke spring 60 to rotate fast idle lever 58 and, via tangs 108, 106 and choke lever 54, to thereby rotate shaft 56 clockwise and thus swing choke plate 62 to its wide open position of FIGS. 38 and 41. The resilience of shaft 56 will thereupon cause it to untwist and then return the orientation of lever 54 to its initial free state condition relative to choke plate 62 shown in FIGS. 38 and 41 and in solid lines in FIG. 40.

It will be understood that the 6° overtravel of lever 54 between the solid and phantom positions shown in FIG. 40 is imparted to lever 54 because lever 54 is positively coupled to lever 58 through the push engagement of the respective tangs 106 and 108. These tangs are yieldably held in abutment under the biasing force of spring 60.

Although 6° override as shown in foregoing working example is preferred in one working embodiment, it is to be understood that the flexible shaft 56 of the invention can be designed to nominally require up to 10° of override rotation to engage the fast idle lever 4. This 10° override capability generally encompasses all of the potential tolerance stack-up conditions, thereby eliminating the incomplete choke closure problem typically encountered with existing fast idle systems.

In addition to the above, the invention is further advantageous in reducing manufacturing cost. The snap-in assembly of choke valve 62 into slot 72 of flexible shaft 56 is simpler and easier to accomplish from the manufacturing standpoint than the current production valve that is retained on a rigid metal choke shaft with a fastening screw and Loctite® brand adhesive. Although the flexible plastic choke shaft thus appears to be the best, lowest cost option for obtaining the preferred construction of the invention, it is to be understood that it is also possible to allow or accomplish override by making the choke valve plate 62 from flexible material, or by otherwise introducing a spring biased, lost motion operational coupling that enables the choke lever 52 to over-rotate up to approximately 10° after travel stoppage of choke valve 56.

What is claimed is:

1. In a control mechanism for a fuel/air mixing apparatus having a throttle valve and a choke valve, said throttle valve having closed low speed idle, fast idle cold start and full speed open positions and said choke valve having cold start closed and full speed open positions, said control mechanism including first biasing means biasing said throttle valve toward its idle position, second biasing means biasing said choke valve toward its full speed position, interengageable automatic mechanical releasable latch means associated with the respective valves for releasably holding both valves in their cold start positions in opposition to the biasing means while allowing movement of said choke valve from its idle position toward its full speed position, said interengageable latch means being released by movement of the throttle valve from its cold start position toward its full speed position, said latch means comprising a choke lever and a fast idle latch lever associated with said choke valve, said choke lever having a formation for engaging a cooperative formation on said fast idle lever when said choke valve is moved from its full speed position toward its cold start position for holding said choke and fast idle lever in interengagement when so moving in opposition to the respective biasing means, and a throttle lever associated with said throttle valve for moving said throttle valve between its low speed idle position and its full speed position and being latch-engageable with said fast idle lever, said latch means comprising a ratchet notch on one of said fast idle and throttle levers and a pawl on the other one of said fast idle and throttle levers for releasably engaging and holding said fast idle and throttle levers in releasable one-way clutch interengagement, the improvement wherein said latch means includes a lost motion coupling between said choke valve and fast idle lever to enable override between said ratchet notch and said pawl after said choke valve reaches fully closed position.

2. The control mechanism of claim 1, further including control means coupled to said choke for moving said choke valve between its cold starting and full speed positions during interengagement of said interengageable means.

3. The control mechanism of claim 2 wherein said choke valve is pivotally mounted on a rotatable choke valve shaft, said fast idle lever is pivotable about said choke shaft and wherein said choke lever is non-rotatably pivotally mounted on said choke shaft, said formations on said choke and fast idle levers comprising cooperating abutment means causing said fast idle lever to pivot in unison with said choke lever when force is applied to choke lever in one direction for pivoting said choke valve from its open position into its cold starting position and bringing said fast idle and throttle levers into releasable latched interengagement, said choke lever being pivotable independently of said fast idle lever when said fast idle lever and throttle lever are interengaged in order to pivot said choke valve between its cold starting and full speed open positions, and said abutment means effecting pivoting of said fast idle lever and said choke lever in unison on release of said interengageable means to pivot said choke valve from its cold starting position to its open position, and wherein said lost motion coupling comprises a torsionally resilient section of said choke shaft located between said choke valve and said choke lever.

4. The control mechanism of claim 3 wherein said second biasing means comprises a coil spring means surrounding said choke shaft and acting on said fast idle lever.

5. The control mechanism of claim 3 wherein said ratchet notch is provided on a free end of said fast idle lever, and said pawl is provided on a free end of said throttle lever.

6. The control mechanism of claim 5 wherein said torsionally resilient section of said choke shaft can accommodate an angular range of resilient twisting at least equal in angular pivot travel to the opposite end limits of angular pivot swing tolerances of said fast idle lever when within a given angular range of pivotal positions corresponding to said choke valve reaching its fully closed cold start position.

7. In a carburetor having a mixing passage, a throttle valve disposed in said mixing passage and movable between a low idle closed position and a wide open throttle position, spring means biasing said throttle valve toward the low idle position, a first control lever operable to movably displace said throttle valve between low idle and wide open positions, a choke valve movably mounted in said mixing passage, a second control lever operable to displace said choke valve between predetermined closed start and open rest positions, and cold-start holding means which when actuated by said second control lever moves said throttle valve to a predetermined cold start fast idle position via latch means, said latch means being released when said throttle valve is moved from fast idle toward open position to thereby allow said throttle valve to be controllably displaced between low idle position and wide open position against the biasing force of said spring means, said latch means comprising notch means and cooperative pawl means operatively coupled to said choke and throttle valves for releasable one-way stop movement of said choke and throttle valves when said valves are being moved by coupling operation of said latch means to their predetermined cold start positions, the improvement wherein said second control lever is coupled to said choke valve by resilient lost motion means operable to enable override motion of said lever past its position causing displacement of said choke valve to its closed start position to thereby ensure latch up of said notch and pawl means.

8. The carburetor as set forth in claim 7 wherein said valves are pivoted to said respective valve positions, and said cold start holding means comprises said second control lever, said second control lever being pivotal about a rotational axis of said choke valve and being rotationally coupled thereto and having limited resilient angular lost motion relative thereto, said latch means being disposed on a fast idle lever operably coupled to said second control lever for one-way pivotal motion thereafter, said first control lever being operably coupled to said throttle valve for two-way pivotal motion therewith, said latch means also being disposed on said first control lever and cooperable with said latch means on said fast idle lever to perform as said cold-start holding means.

9. In a carburetor throttle and choke control mechanism incorporating a choke-throttle cold-start setting latch mechanism that automatically positions a throttle valve slightly open at a fast idle position when the choke valve is swung from open to fully closed position, and comprising a rotatable choke shaft carrying a choke plate valve, a rotatable throttle shaft carrying a throttle plate valve, a choke lever fixed on said choke shaft for rotating said choke valve from open to closed positions against the bias of a choke return spring, a throttle lever fixed on said throttle shaft for rotating said throttle valve from closed to open positions against the bias of a throttle return spring, and a fast idle latch lever journalled on said choke shaft and having a free end swingable in a travel path generally co-planar with and intersecting the travel path of a free end of said throttle lever, and releasable latch means on said free ends interengageable as a toggle that is held latched by said return springs in the choke-closed position of said choke valve and the fast idle position of said throttle valve, the improvement in combination therewith wherein at least one of said choke shaft and said choke plate valve is resilient to enable lost-motion, spring-biased override of said latch means free ends to ensure that same are engageable when said choke plate valve is being held fully closed.

10. The mechanism set forth in claim 9 wherein said choke shaft is molded of semi-resilient plastic material and protrudes at one end axially exteriorly of the carburetor, said choke lever being fixed on said one end of said choke shaft, said choke shaft having a portion disposed interiorly of the carburetor and extending across a main air/fuel mixture venturi bore of the carburetor in which said choke and throttle valves are operably disposed, said choke shaft having a through-slot in a second portion thereof, said choke plate valve being inserted through said slot to thereby mount said choke plate valve on said choke shaft.

11. The mechanism set forth in claim 10 wherein said choke plate valve is provided with detent protrusions adapted to provide snap-in retention of said choke valve plate upon reaching a fully assembled position when being inserted through said slot in said choke shaft.

12. The mechanism set forth in claim 11 wherein said second portion of said choke shaft is generally cylindrical in cross section and wherein said first portion of said shaft has a cruciform ribbed cross section to render said first portion generally more torsionally resilient per unit of axial incremental length thereof than said second portion.

13. The mechanism set forth in claim 12 wherein said choke shaft and choke lever are integrally molded as a one piece unit.

14. The mechanism set forth in claim 9 wherein said choke shaft is torsionally resilient and said choke valve plate is torsionally rigid.

15. The mechanism set forth in claim 9 wherein said choke plate valve is torsionally resilient by flexure thereof and said choke shaft is torsionally rigid.

* * * * *

UNITED STATES PATENT AND TRADEMARK OFFICE

CERTIFICATE OF CORRECTION

PATENT NO. : 6,202,989 B1
DATED : March 20, 2001
INVENTOR(S) : George M. Pattullo It is certified that error appears in the above-identified patent and that said Letters Patent is hereby corrected as shown below:

Column 12,
Line 63, before "choke lever" insert -- said --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*